US007180038B2

(12) United States Patent
Wilde et al.

(10) Patent No.: US 7,180,038 B2
(45) Date of Patent: Feb. 20, 2007

(54) DEVICE FOR SWITCHING ON AND OFF SEVERAL HEATING MECHANISMS OF COOKING EQUIPMENT AS WELL AS COOKING EQUIPMENT WITH SUCH A DEVICE

(75) Inventors: Eugen Wilde, Knittlingen (DE); Erich John, Pforzheim (DE); Hans Mohr, Sulzfeld (DE); Ralf Stoll, Bruchsal (DE)

(73) Assignee: E.G.O. Elektro-Geraetebau GmbH (DE)

( * ) Notice: Subject to any disclaimer, the term of this patent is extended or adjusted under 35 U.S.C. 154(b) by 179 days.

(21) Appl. No.: 10/910,437

(22) Filed: Aug. 3, 2004

(65) Prior Publication Data

US 2006/0027564 A1 Feb. 9, 2006

(51) Int. Cl.
*H05B 3/02* (2006.01)

(52) U.S. Cl. ..... 219/508; 219/481; 219/507; 219/519; 219/494; 307/117

(58) Field of Classification Search ..... 219/481, 219/483, 486, 507, 508, 509, 511, 518, 519, 219/494, 490, 491; 307/117
See application file for complete search history.

(56) References Cited

U.S. PATENT DOCUMENTS 4,281,237 A * 7/1981 Berenson ..... 219/511
4,633,238 A 12/1986 Goessler et al.
4,788,398 A * 11/1988 Hornung ..... 219/483
5,308,957 A * 5/1994 Huffington ..... 219/483
5,498,853 A 3/1996 Gross et al.
6,064,045 A 5/2000 Reichert et al.

* cited by examiner

*Primary Examiner*—Mark Paschall
(74) *Attorney, Agent, or Firm*—Akerman Senterfitt

(57) ABSTRACT

A control is provided for switching on and off two heating devices of a hob forming a hotplate. In cyclic manner the continuous energy or power generation level can be adjusted by an energy control device. A temperature limiter monitors a maximum temperature via the first heating device, but not via the second heating device. The energy control device controls the first heating device directly or switches the same. The temperature limiter trips a power relay in order to switch the second heating device simultaneously with the first heating device.

29 Claims, 3 Drawing Sheets

DEVICE FOR SWITCHING ON AND OFF SEVERAL HEATING MECHANISMS OF COOKING EQUIPMENT AS WELL AS COOKING EQUIPMENT WITH SUCH A DEVICE

BACKGROUND FOR THE INVENTION

1. Field of Application and Prior Art

The invention relates to an appliance for switching on and off several heating devices of a cooker, as well as a cooker having such an appliance.

Radiant heaters with a diameter which can exceed 230 mm exist for hobs with glass ceramic plates, for example. They in part suffer from the problem that an energy or power supply through so-called energy or power control devices on the one hand and an excess temperature protection for the glass ceramic plate over the radiant heater through so-called temperature limiters on the other are limited by the maximum power levels which can be applied and by a so-called flicker standard. The flicker standard indicates how frequently in a specific time period a specific power may be switched on and off for a cooker and is intended to prevent significant supply network reactive effects in line with the power supply companies. The switching capacity of both the power control devices and the temperature limiters, which operate with so-called snap-action switches and such as are for example described in U.S. Pat. Nos. 6,064,045 and 4,633,238, is generally limited. In the USA this is 12 or 13 Ampere, for example, and consequently 100,000 switching cycles must be attainable.

Thus, with the normally predetermined mains voltage, it is not possible to further increase the power of a radiant heater.

2. Problem and Solution

The problem of the invention is to provide the aforementioned appliance and aforementioned cooker enabling the prior art problems to be avoided and which in particular enables the maximum power to be increased, particularly for a hotplate with radiant heating.

This problem is solved by an appliance having the features of claim 1 and a cooker having the features of claim 11. Advantageous and preferred developments of the invention form the subject matter of the further claims and are explained in greater detail hereinafter. By express reference the wording of the claims is made into part of the content of the description. In line with the present application "have" means that this feature can be inter alia provided, independently of further features.

According to the invention, the appliance has a temperature detection device or in certain circumstances forms the latter and has a temperature-dependent, thermomechanical release or tripping movement as the operating principle. The temperature detection device has a first switching device or is connected thereto and can be directly operated at an adjustable tripping point by a tripping movement in order to switch on and off the first switching device. A second switching device is provided for switching on and off the second heating device. Said second switching device is also activatable by the tripping movement. Both the first and second switching devices are designed for switching the heating power of the particular heating device, that means as so-called power switches, relays, for example. They are so constructed that they achieve the necessary number of switching cycles. For the second switching device or the tripping thereof, it can be directly or indirectly activated by the tripping movement. In the case of a direct activation the switching contacts are directly moved by the tripping movement. With indirect activation in the sense of the present application the tripping of the first switching device is activated by the tripping movement and the signal caused by the same or a switched voltage activates the second switching device. Thus, here activation does not take place in direct mechanical manner via the tripping movement.

Thus, it is possible as a result of the invention to create a temperature detection device which, in place of a conventional temperature limiter, such as can be gathered from U.S. Pat. No. 4,633,238, for example, can be used for monitoring the glass ceramic plate of a hob with radiant heater with respect to excess temperatures. The two heating devices belong to a single hotplate, that means at least on occasions are operated jointly. In particular there is a two or multiple circuit hotplate. Thus, the temperature detection device trips the first and second switching devices and each switching device switches on or off the particular associated heating device. Thus, in the case of an excess temperature, the total power of the hotplate no longer has to be switched by a single switching device of the temperature detection device, so that the total power of the heating devices or hotplate can be increased.

Preferably, when using relays as switching devices, they are so designed that when a current is not flowing through them, that means in the deactivated or uncontrolled state, they are opened. The heating devices connected thereto are then switched off.

According to a first possibility provided by the invention, the second switching device can be directly activated by the first switching device. This can for example take place in that with the first switching device closed for switching on the first heating device the second switching device receives a corresponding electric signal so as to then activate or switch on the second heating device. Alternatively and as a result of the connection of the first heating device to a supply voltage, the second switching device can be supplied with energy for activation. Thus, in this embodiment, the second switching device is not directly activated by the tripping movement and is instead indirectly activated, in that it is controlled by the first switching device activated by the tripping movement.

In another possibility provided by the invention, it is possible to provide a third switching device, which is connected or coupled to the temperature detection device and at an adjustable tripping point can be directly operated by the tripping movement. An operation advantageously takes place simultaneously with the first switching device, that means at the same tripping point. Such a third switching device can directly activate or supply energy to the second switching device, so that it correspondingly switches on or off the second heating device. Thus, here the second switching device is activated by the third switching device, unlike in the previous embodiment where this takes place through the first switching device. This offers the advantage that in this case no further functions or connections have to be provided for the first switching device, but it is necessary to provide the third switching device. However, it is also possible to use a switching device for this purpose which is already present in conventional temperature limiters, such as for example according to U.S. Pat. No. 4,633,238, for indicating a temperature of above 100° C., for example, so as to constitute a hot indicator.

According to another possibility of the invention it is also possible to incorporate the second switching device into the temperature detection device in the same way as the first switching device and in particular with the same construction. In this case increased constructional demands are made, particularly with respect to insulation resistances and gaps.

The third switching device for controlling the second switching device can either operate with a lower voltage than the mains voltage or can be designed for significantly lower currents. Its function is merely to switch the activation current for the second switching device. In the case of power relays and in certain circumstances electronic switches this is relatively low, so that no increased mechanical or contact-specific demands have to be made on the third switching device.

The temperature detection device can advantageously have an expansion device, which expands or brings about a mechanical tripping movement as a function of the detected temperature. It can be a temperature limiter according to U.S. Pat. No. 4,633,238, to which express reference is made. Such a temperature limiter can have two elongated, parallel longitudinal elements, which are coupled at one end and have different temperature expansion coefficients. At a predetermined or detected temperature they expand to a varying degree and this relative movement leads to the tripping movement, because the relative movement between them occurs at the uncoupled end. For this purpose one of the elements can be fixed to the temperature detection device. The other moves relative thereto and gives rise to a force which, together with the tripping movement, can for example operate a switching device or the like.

According to a further development the appliance can have a control for the heating devices or can be connected thereto, for example in the form of a so-called timing or cyclic energy control device. As a result thereof radiant heaters, for example, can be operated cyclically, which means that they are either switched off or switched on at full power. Therefore the level of the energy generation at the heating devices can be predetermined over several cycles or over and beyond a specific time. This is described in U.S. Pat. No. 6,064,045 to which express reference is made. When the control is switched off none of the aforementioned switching devices is activated or activatable. This ensures that the level of the energy generation or the nature of the timing is predetermined by the control or the energy control device. The temperature detection device advantageously merely provides an overheating protection of a glass ceramic plate, for example, against excessive heating by the heating devices.

A cooker according to the invention can contain an aforementioned appliance for at least two independently controllable heating devices. These two heating devices form a hotplate or are very closely juxtaposed, so that in some modes they can be operated jointly for heating a single correspondingly large, stood-on cooking vessel. The first heating device is the main heating device, whereas the second heating device is an additional heating device. The second device can either be connected laterally and roughly over roughly a half to the first heating device and can optionally even completely surround the same. For smaller cooking vessels, they are heated solely by the first heating device. With larger cooking vessels covering the entire surface area of the first and second heating devices, both heating devices are used jointly. With such a joint use, it is naturally advantageous if the temperature detection device in the case of an excess temperature in an area, particularly of the first heating device, not only switches off the latter, but in fact both heating devices. Otherwise and in particular when using radiant heaters, an unaccustomed picture would arise for the user.

Advantageously the power of the first heating device is significantly higher than that of the second heating device and is roughly twice as high, for example.

For the second heating device it is possible to provide a maximum continuous power output corresponding to a power density of max. approximately 2.5 W/cmý. Such a value has the advantage that when using radiant heaters and a glass ceramic plate as the hob, such a power density can be operated so-to-speak in unprotected form, that is without any temperature monitoring for the glass ceramic. Dangerous temperatures of approximately 550° C. and higher cannot be obtained. Such power densities cannot lead to an overheating of the glass ceramic. The power density can also be selected above 2.5 W/cmý if the glass ceramic manufacture's specifications or tests reveal or allow this.

This makes it possible for the temperature device in its function as an overheating protection to only have to monitor the first heating device, but not the second heating device. It can for example cover the first heating device, but not the second heating device. It can alternatively be deactivated in the area of the second heating device. For this purpose it is possible, for example in the case of a rod control unit in the area to be deactivated of one of the two longitudinal elements to be partly replaced by another partial longitudinal element, which has the same temperature expansion as the other longitudinal element. Thus, by heating in the area to be deactivated, there is no relative movement or no contribution to a relative movement.

The cooker can advantageously have a timing or cyclic energy control device, as described hereinbefore and as can for example be gathered from U.S. Pat. No. 6,064,045. This energy control device is constructed for at least for activating the first heating device. Due to the fact that the second heating device is controlled or activated by means of the aforementioned appliance or temperature detection device and the power level of the heating devices is determined by the energy control device, this predetermines the on and off times both for the first heating device and consequently the second heating device.

According to a further development a fourth switching device can be provided and which, independently of the second or third switching device, activates or deactivates the second heating device for synchronous operation with the heating device. This fourth switching device can for example make it possible for a user, as a function of the size of the stood-on cooking vessel, to activate or not activate the additional heater. It can for example be formed by a power switch looped into the supply voltage and in particular a relay, with a corresponding control for a user, for example a contact switch. The second switching device can be provided separately from the energy control device on the cooker. In the manner described hereinbefore, it can be a separate power switch, particularly a relay.

These and further features can be gathered from the claims, the description and the drawings and the individual features, both singly or in the form of subcombinations, can be implemented in an embodiment of the invention and in other fields and can represent advantageous, independently protectable constructions for which protection is claimed here. The subdivision of the application into individual sections and the subheadings in no way limit the general validity of the statements made thereunder.

BRIEF DESCRIPTION OF THE DRAWINGS

Embodiments of the invention are described in greater detail hereinafter relative to the attached drawings, wherein show.

DETAILED DESCRIPTION OF THE EMBODIMENTS

Figure 1:
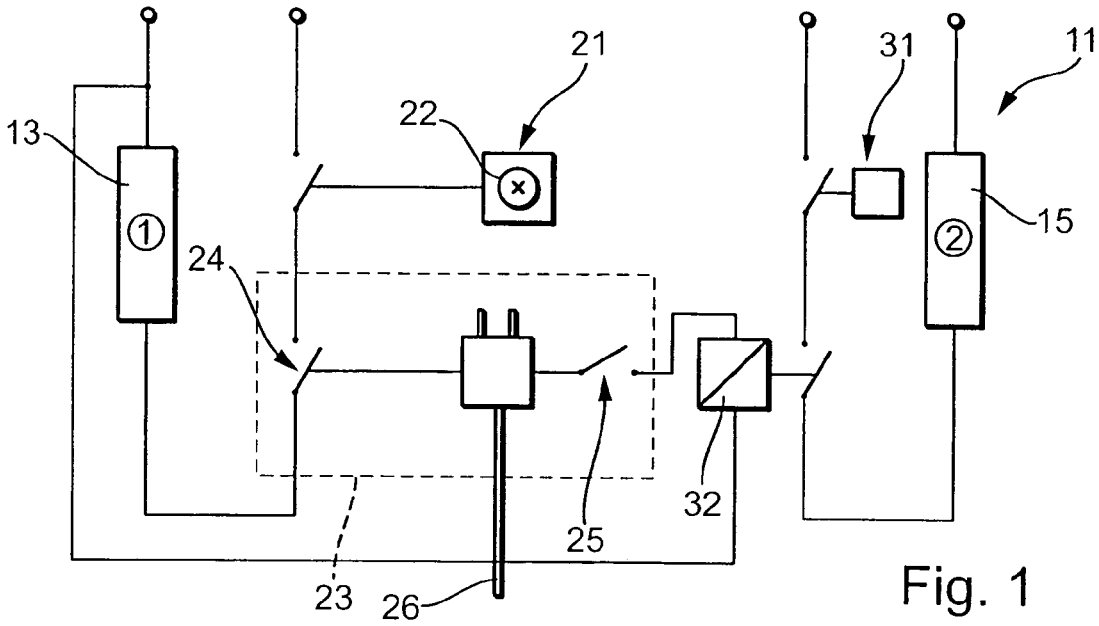
FIG. 1 An operating diagram of an arrangement with which two heating devices can be controlled by means of an energy control device and a temperature limiter.

FIG. 1 is an operating diagram of an appliance 11 according to the invention enabling the control of a first heating device 13 and a second heating device 15. They can form a so-called double circuit heater in the manner shown in FIG. 2 and explained in greater detail with respect thereto. Both heating devices 13 and 15 are radiant heaters, such as are for example described in U.S. Pat. No. 5,498,853. They are operated with the mains voltage, for example 240 V. Their operation conventionally takes place in cyclic form, so that a heating device is either applied to the supply voltage and operates with full power or is separated from the supply voltage and consequently deactivated. The level of the energy generation over and beyond a certain time period does not take place by reducing the supply voltage for continuous operation, but instead by cycles with on times and off times. As a result of the cyclic ratio or the length of the on and off times, it is possible to bring about a so-called averaged energy generation or a so-called average power is obtained.

An energy control device 21 is provided for controlling the first heating device 13, namely cyclically with on and off times as described hereinbefore. This energy control device 21 is for example described in U.S. Pat. No. 6,064,045 to which express reference is made. Through a rotary movement on a toggle 22 by an operator it is possible to set a particular cooking stage or step, which determines the level of the energy generation of the heating device 13 or the average power. Conventionally it is subdivided into so-called cooking stages, for example in half steps from zero to nine. As a function thereof the energy control device 21 with the switch shown and which corresponds to the previously described first switching device, switches the heating device 13 on or off in the predetermined on and off times.

The temperature limiter 23 shown in functionally dot-dash line bordered manner is for example described in U.S. Pat. No. 4,633,238. The temperature limiter 23 has a first switch 24 corresponding to the aforementioned first switching device. It also has a third switch 25, which functionally corresponds to the aforementioned third switching device. Further reference will be made thereto hereinafter. The temperature limiter 23 additionally has an elongated sensor 26, comprising an outer sensor tube 27 and inner rods 28*a*, 28*b* located therein and whose function will be explained relative to FIG. 4.

As a function of a temperature via heating devices 13 and 15 detected by the sensor 26, the first switch 24 is opened or closed. Up to a conventionally set temperature in the range 550 to 650° C. the first switch 24 is closed and the energy supply or activation of the first heating device 13 takes place exclusively by means of the energy control device 21. On exceeding this limiting temperature, to which further reference will be made hereinafter, the temperature limiter 23 opens the first switch 24 and the first heating device 13 is switched off or deactivated.

The appliance 11 also has a second heating device 15. The latter, like the first heating device 13, can be constructed as a radiant heater with the same cyclic operation. By means of an additional switch 31 an activation of the second heating device 15 is brought about by the operator. There is also a power relay 32 in the energy supply and corresponds to the aforementioned, second switching device. Only if the additional switch 31 and power relay 32 are closed is the second heating device 15 activated. For controlling the power relay 32 in connection with the temperature limiter 23 the third switch 25 is used and it is normally provided for a hot indication, although this does not apply here. In this case it corresponds to the aforementioned third switching device. It is possible for the power relay 32 to only close and therefore activate the second heating device 15 if the temperature limiter 23 is connected to the supply voltage, that is if the energy control device 21 provides an on time. It also applies here that the first switch 24 and third switch 25 are always simultaneously opened or closed in each case, so that the heating devices 13 and 15 in the case of joint operation are jointly and in each case simultaneously switched on or off.

It is also possible to provide in the control for the third switch 25 only being able to supply a voltage to the power relay 32 when the first switch 24 is closed. Thus, the power relay 32 can be activated both as a function of the switching state of the third switch 25 and also as a function of the switching state of the first switch 24 for the purpose of switching on the second heating device 15.

Figure 2:
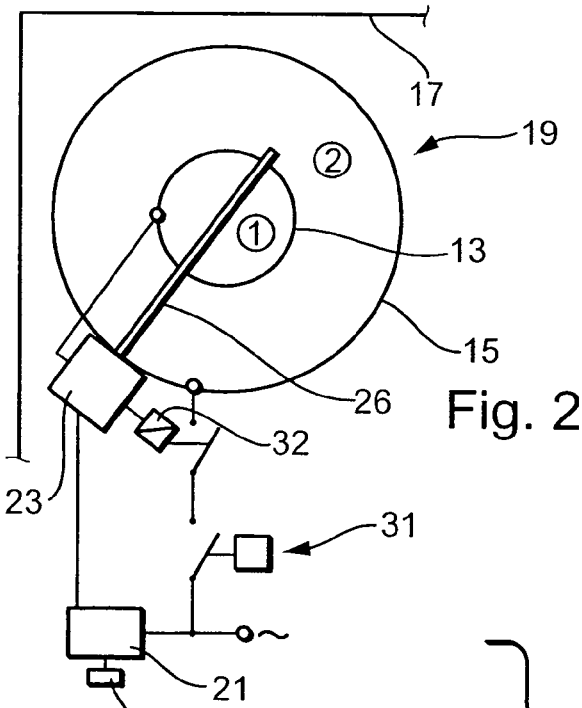
FIG. 2 The arrangement according to FIG. 1 forming a hotplate of a hob.

FIG. 2 shows how the first heating device 13 as an inner heating circuit and the second heating device 15 as an outer heating circuit form a hotplate 19 of a hob 17 of an electrical appliance with a glass ceramic plate 18. With the sensor 26 the temperature limiter 23 extends from the outside transversely over a circular ring of the second heating device 15 and fully over the first heating device 13. In the area over the second heating device 15 the sensor 26 is deactivated, as will be explained in conjunction with FIG. 4.

It is also shown how the supply line to the first heating device 13 passes via the temperature limiter 23 or the first switch 24. The energy control device 21 is provided with the toggle 22, which is connected to the supply voltage and controls the hotplate 19.

It is possible to connect in the second heating device 15 by means of the additional switch 31 fitted to the hob 17 and which comprises an operating or control element which can be reached by an operator or user and the switch shown. The temperature limiter 23 makes it possible to control the power relay 32 and also the first heating device 13, so as in this way to connect the second heating device 15 to the supply voltage.

Figure 3:
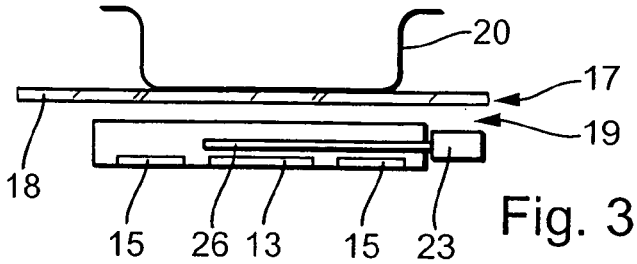
FIG. 3 The arrangement according to FIG. 2 in side view with the hotplate under a glass ceramic plate.

FIG. 3 shows the arrangement of FIG. 2 in side view. It can be seen that the sensor 26 of the temperature limiter 23 runs above the heating devices 13 and 15, that is between the same and the underside of the glass ceramic plate 18. As the spacing of the heating devices 13 and 15 and that of the sensor 26 with respect to the underside of the glass ceramic plate 18 is known, the temperature limiter 23 can be set to a switch-off temperature or limiting temperature corresponding to a temperature limit on the glass ceramic plate 18 which is not to be exceeded.

Figure 4:
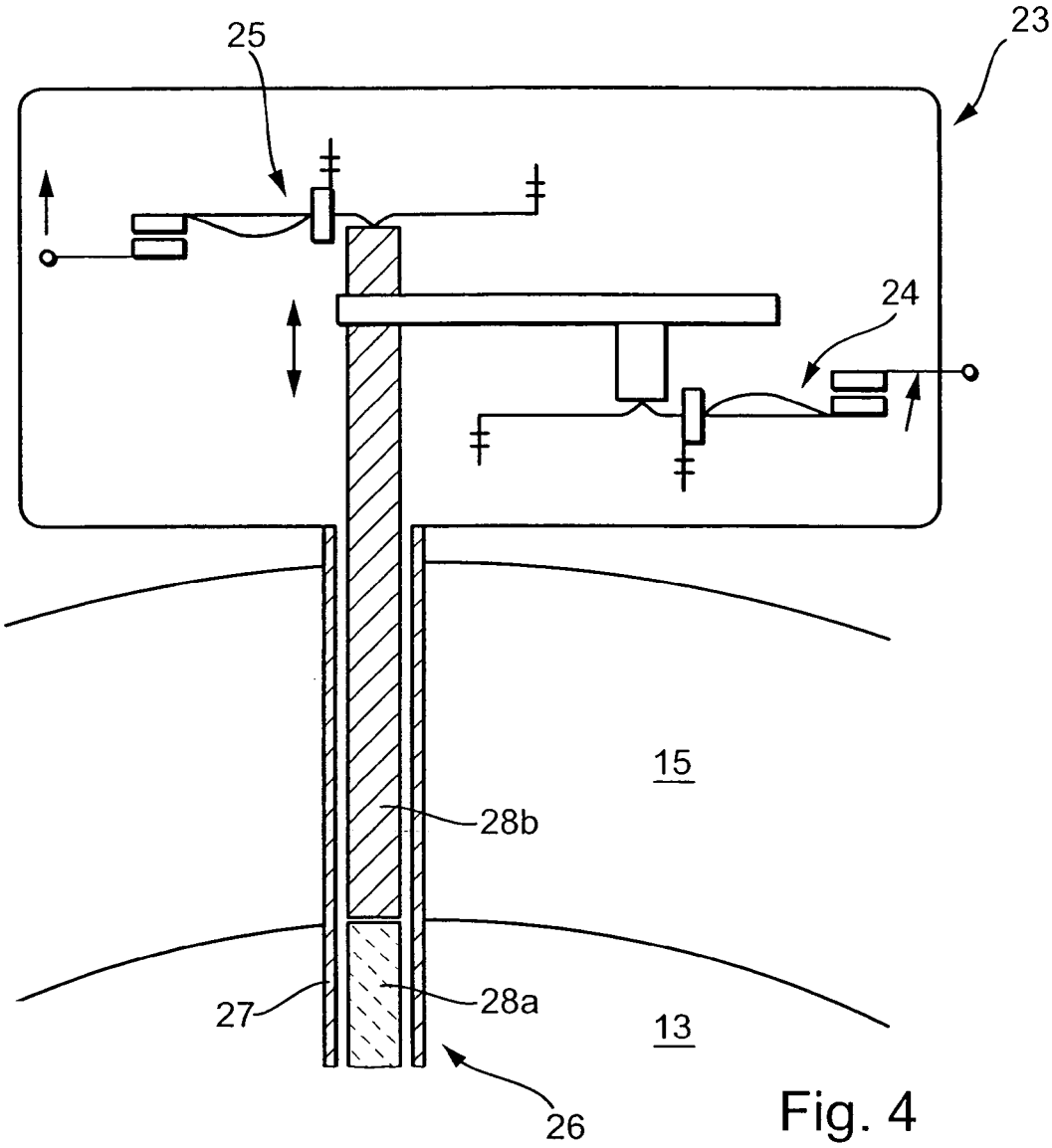
FIG. 4 A plan view of the internal structure of a temperature limiter constructed as a so-called rod control unit.

FIG. 4 shows in detail the temperature limiter 23 together with the sensor 26. The sensor 26 comprises an outer sensor tube 27 and two inner rods 28*a*, 28*b*. The sensor tube 27 is for example metallic and is fixed to a casing of the temperature limiter 23. The inner rod 28 and sensor tube 27 are interconnected at the not shown, remote end of the sensor 26, for example by locking or by a stop member. In the area above the first heating device 13 where the sensor 26 is active or the temperature is to be detected, the inner rod 28*a* can be made from ceramic, and has a negligible temperature expansion coefficient. With increasing temperature the sensor tube 27 expands much more than the inner rod 28*a*. Consequently there is a movement of the complete inner rod relative to the sensor tube, so that the switches 24 and 25 are moved or switch.

For the deactivation of the sensor 26 in the area above the second heating device 15 the inner rod 28*b* is made there from the same material as the sensor tube 27. As their expansion coefficients are then precisely the same, the heat occurring there or the temperature prevailing there does not contribute to the behaviour of the sensor 26 or to the relative movement.

Deactivation of the sensor 26 via the second heating device 15 serves the function and can only be carried out if the power of the second heating device 15 is so low that it does not exceed an area-related heating power of approximately 2.5 W/cmý, as stated hereinbefore. Thus, the choice of this heating power makes it possible to make do without any temperature limitation in the vicinity of the second heating device 15 and consequently no temperature limiter is needed. Thus, the attainable overall heating power of the hotplate 19, which appropriately for avoiding unnecessary expenditure is only to be monitored by a single temperature limiter, can be chosen higher than would be possible if the complete current had to be switched exclusively via the temperature limiter 23. In this case the temperature limiter 23 for activating the additional second heating device 15 is only used as a signal-generating control.

This subdivision of the hotplate 19 into two heating devices 13 and 15 can, as has been essentially described hereinbefore, be provided so that as a function of the cooking vessel size used a simple, appropriate power control takes place. By means of the additional switch 31 an operator decides whether the second heating device 15 has to be used as a result of a corresponding cooking vessel.

It is alternatively possible to use the two heating devices 13 and 15 not with respect to variable size adaptation, but instead always together, so as to provide a maximum heating power at the hotplate and so as to only have one temperature limiter 23 and a single switch in the energy control device 21. There is then no need for the additional switch 31 and the second heating device 15 is either simultaneously switched on or off together with the first heating device 13.

As an alternative to the provision of the heating devices 13 and 15 according to FIG. 2 in the form of separate, mutually surrounding zones, it is also possible to construct them in mixed form and essentially so as to cover the same surface area.

Figure 5:
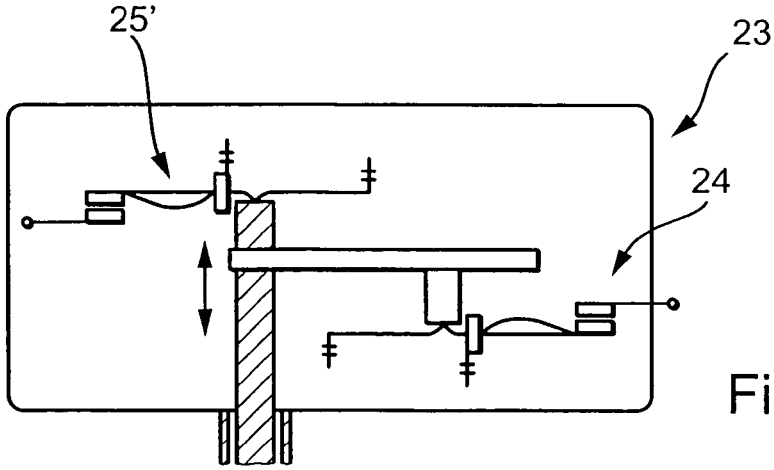
FIG. 5 An alternative construction of a temperature limiter.

Another alternative is shown in FIG. 5, where there is no power relay 32 and the third switch 25' corresponds to the above-described, second switching device, but directly switches the power for the second heating device 15. In this case it is constructed as a power switch in much the same way as the first switch 24. However, a conventional temperature limiter 23 must be constructionally modified so that in particular at limited cost two mains voltage switches or power switches 24 and 25' are present in a single casing and then there is no need for the second power relay 32.

Figure 6:
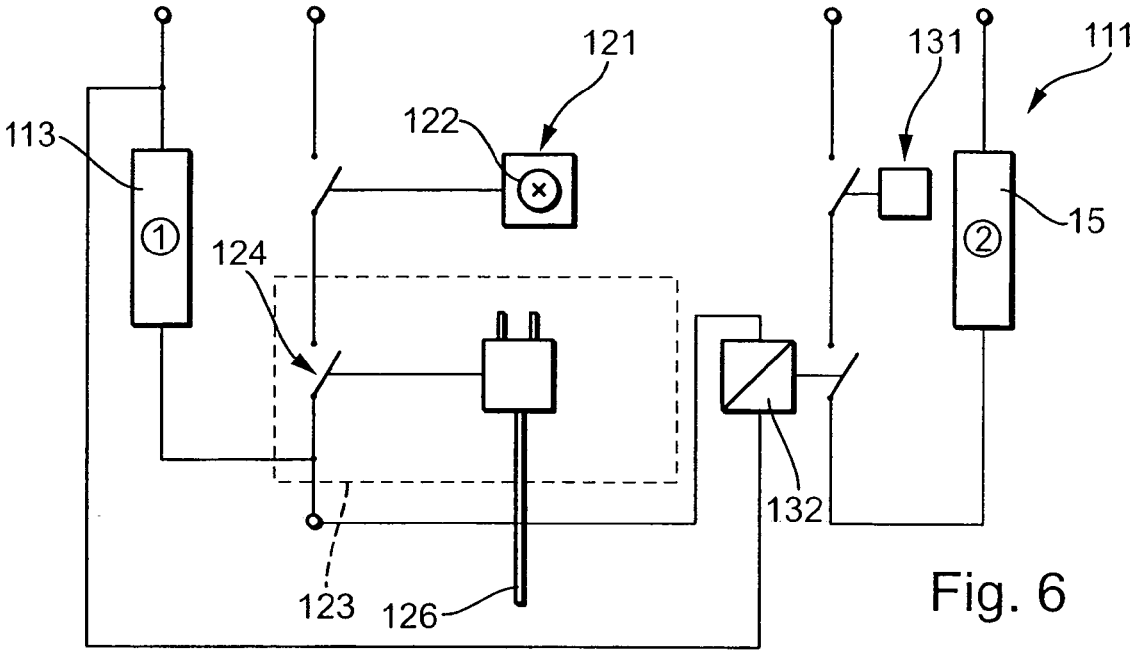
FIG. 6 Another alternative construction of the arrangement according to FIG. 1.

Another alternative arrangement 111 to that of FIG. 1 is shown in FIG. 6. The relay 132 is here controlled not via a further switching device in the temperature limiter 123 symbolized in dot-dash line form. On the switch 124, which corresponds to switch 24 in FIG. 1, is provided a contact P1 to which is connected the relay 132. Thus, the switch 124 controls both the heating device 113 in direct form and also the second heating device 115 in indirect form via the activation of the relay 132. The two heating devices 113 and 115 are always simultaneously in operation. Relay 132 corresponds to the second switching device according to the invention. As the first switch 124 is tripped by the activation movement in the temperature limiter, the relay 132 is also tripped in line with the invention.

The invention claimed is:

1. An appliance for switching on and off a plurality of heating devices of a cooker, comprising:

a temperature detection device with temperature-dependent, thermo-mechanical tripping movement for switching devices;

a first switching device connected to said temperature detection device for the purpose of switching on and off a first heating device directly through said tripping movement at an adjustable tripping point; and a second switching device for switching on and off a second heating device of said cooker, said second switching device also being activatable by said tripping movement, wherein said second switching device is a relay, wherein said second switching device is directly activatable by said first switching device, and wherein said first switching device is closed for switching on said first heating device, said second switching device receiving an electric signal or being supplied with energy from connection of said first heating device to a supply voltage for activation for switching on said second heating device.

2. The appliance according to claim 1, wherein said relay is opened when no current flows through.

3. The appliance according to claim 1, wherein there is a third switching device connected or coupled to said temperature detection device and directly operable by said tripping movement at an adjustable tripping point.

4. The appliance according to claim 3, wherein said third switching device is simultaneously operable with said first heating device at said same tripping point, said third switching device directly activating or supplying with energy said second switching device for switching on or off said second heating device.

5. The appliance according to claim 3, wherein said third switching device is contained in said temperature detection device in a same casing as said first switching device.

6. The appliance according to claim 1, wherein said temperature detection device has an expansion device for said tripping movement in the form of a rod control unit with at least two elongated, parallel longitudinal elements, which have different temperature expansion coefficients and whose differing expansion at a predetermined temperature brings about said tripping movement, and wherein both elements are coupled at a remote end, one element is fixed to said temperature detection device and said other end moves relative thereto and brings about said tripping movement.

7. The appliance according to claim 1, further comprising a control in the form of a cyclic energy control device, which determines the level of the power generation at said heating devices and when said control is switched off none of said switching devices are activated or activatable.

8. An appliance for switching on and off a plurality of heating devices of a cooker, comprising:

a temperature detection device with temperature-dependent, thermo-mechanical tripping movement for switching devices;

a first switching device connected to said temperature detection device for the purpose of switching on and off a first heating device directly through said tripping movement at an adjustable tripping point;

a second switching device for switching on and off a second heating device of said cooker, said second switching device also being activatable by said tripping movement; and a third switching device connected or coupled to said temperature detection device and directly operable by said tripping movement at an adjustable tripping point.

9. The appliance according to claim 8, wherein said second switching device is a relay.

10. The appliance according to claim 9, wherein said relay is opened when no current flows through.

11. The appliance according to claim 8, wherein said second switching device is directly activatable by said first switching device.

12. The appliance according to claim 8, wherein said first switching device is closed for switching on said first heating device, said second switching device receiving an electric signal or being supplied with energy from connection of said first heating device to a supply voltage for activation for switching on said second heating device.

13. The appliance according to claim 8, wherein said third switching device is simultaneously operable with said first heating device at said same tripping point, said third switching device directly activating or supplying with energy said second switching device for switching on or off said second heating device.

14. The appliance according to claim 8, wherein said third switching device is contained in said temperature detection device in a same casing as said first switching device.

15. The appliance according to claim 8, wherein said temperature detection device has an expansion device for said tripping movement in the form of a rod control unit with at least two elongated, parallel longitudinal elements, which have different temperature expansion coefficients and whose differing expansion at a predetermined temperature brings about said tripping movement, and wherein both elements are coupled at a remote end, one element is fixed to said temperature detection device and said other end moves relative thereto and brings about said tripping movement.

16. The appliance according to claim 8, further comprising a control in the form of a cyclic energy control device, which determines the level of the power generation at said heating devices and when said control is switched off none of said switching devices are activated or activatable.

17. A cooker comprising:

at least two independently controllable heating devices forming a hotplate or which are very closely juxtaposed in order to bring about at least in some cases a joint activation or heating, a first of said heating devices being a main heating device and a second of said heating devices being an additional heating device; and an appliance for switching on and off said plurality of heating devices, said appliance comprising:

a temperature detection device with temperature-dependent, thermo-mechanical tripping movement for switching devices;

a first switching device connected to said temperature detection device for the purpose of switching on and off a first heating device directly through said tripping movement at an adjustable tripping point; and a second switching device for switching on and off a second heating device of said cooker, said second switching device also being activatable by said tripping movement, wherein said second switching device is a relay, wherein said second switching device is directly activatable by said first switching device, and wherein said first switching device is closed for switching on said first heating device, said second switching device receiving an electric signal or being supplied with energy from connection of said first heating device to a supply voltage for activation for switching on said second heating device.

18. The cooker according to claim 17, wherein said second heating device surrounds said first heating device or is connected laterally thereto.

19. The cooker according to claim 17, wherein power of said first heating device is higher than that of said second heating device.

20. The cooker according to claim 17, further comprising a cyclic energy control unit, which switches on and off at least said first heating device for bringing about a specific power over and beyond a specific time, said power either being zero or 100%.

21. The cooker according to claim 17, wherein said second switching device is constructed separately from said energy control device on said cooker.

22. The cooker according to claim 17, wherein said temperature detection device has an expansion device for said tripping movement in the form of a rod control unit with at least two elongated, parallel longitudinal elements, which have different temperature expansion coefficients and whose differing expansion at a predetermined temperature brings about said tripping movement, and wherein said expansion device covers said first heating device, but not said second heating device or is at least deactivated in the vicinity of said second heating device or one of said two longitudinal elements is replaced by a further element having the same temperature expansion as said other longitudinal element.

23. A cooker comprising:

at least two independently controllable heating devices forming a hotplate or which are very closely juxtaposed in order to bring about at least in some cases a joint activation or heating, a first of said heating devices being a main heating device and a second of said heating devices being an additional heating device; and an appliance for switching on and off said plurality of heating devices, said appliance comprising:

a temperature detection device with temperature-dependent, thermo-mechanical tripping movement for switching devices;

a first switching device connected to said temperature detection device for the purpose of switching on and off a first heating device directly through said tripping movement at an adjustable tripping point;

a second switching device for switching on and off a second heating device of said cooker, said second switching device also being activatable by said tripping movement; and a third switching device connected or coupled to said temperature detection device and directly operable by said tripping movement at an adjustable tripping point.

24. The cooker according to claim 23, wherein said second heating device surrounds said first heating device or is connected laterally thereto.

25. The cooker according to claim 23, wherein power of said first heating device is higher than that of said second heating device.

26. The cooker according to claim 23, further comprising a cyclic energy control unit, which switches on and off at least said first heating device for bringing about a specific power over and beyond a specific time, said power either being zero or 100%.

27. The cooker according to claim 23, wherein said second switching device is constructed separately from said energy control device on said cooker.

28. The cooker according to claim 23, wherein said temperature detection device has an expansion device for said tripping movement in the form of a rod control unit with at least two elongated, parallel longitudinal elements, which have different temperature expansion coefficients and whose differing expansion at a predetermined temperature brings about said tripping movement.

29. The cooker according to claim 23, wherein a fourth switching device is provided and activates or deactivates said second heating device independently of said second switching device for simultaneous operation with said first heating device through said cyclic energy control device.

* * * * *